United States Patent [19]

Glesser

[11] Patent Number: 4,776,094

[45] Date of Patent: Oct. 11, 1988

[54] SNAP SHACKLE UTILITY KNIFE

[76] Inventor: Louis Glesser, P.O. Box 800, Golden, Colo. 80402

[21] Appl. No.: 125,149

[22] Filed: Nov. 25, 1987

[51] Int. Cl.[4] ..... B26B 1/04; B26B 1/10

[52] U.S. Cl. ..... 30/160; 7/119; 7/168; 30/296 A

[58] Field of Search ..... 30/155, 158–160, 30/296 R, 296 A; 7/119, 158, 161, 167, 168

[56] References Cited

U.S. PATENT DOCUMENTS

| | | | |
|---|---|---|---|
| 303,855 | 8/1884 | Hunt | 30/158 X |
| 699,207 | 5/1902 | Moe | 30/158 X |
| 1,127,609 | 2/1915 | Feyrer | 7/119 |
| 1,645,101 | 10/1927 | Gibb et al. | 30/155 X |

FOREIGN PATENT DOCUMENTS

| | | | |
|---|---|---|---|
| 17031 | 9/1903 | United Kingdom | 30/296 A |

*Primary Examiner*—Frank T. Yost
*Attorney, Agent, or Firm*—Roger A. Marrs

[57] ABSTRACT

A utility knife is disclosed herein having an elongated body pivotally housing a knife blade adapted to be moved between a folded position within a storage cavity and an operative position extended from one end of the body. A cutting edge is provided along one side of the blade and a finger grasping protrusion is integrally carried on its opposite side for moving the blade between its two positions. A snap shackle is carried on the end of the body adjacent to the pivot connection of the blade so that the shackle substantially fits the contour of the blade protrusion when the blade is extended into its operative position and so that the shackle is exposed when the blade is in its storage position. One side of the body displays a measuring scale and as an option, a pry bar may be integrally carried on the body end opposite from its end pivotally carrying the folding blade.

10 Claims, 1 Drawing Sheet

SNAP SHACKLE UTILITY KNIFE

BACKGROUND OF THE INVENTION

1. Field of the Invention

The present invention relates to the field of pocket knives and more particularly to a novel knife of this type which includes a snap shackle for releasably carrying the knife from the belt or belt loop of the user and which further is provided with implements or tools for ancillary use with respect to a folding blade.

2. Brief Description of the Prior Art

In the past, it has been the conventional practice to either store knives in the pocket of the user, in a sheath or holder carrier on the belt or by means of a clip suspending the knife from the edge of a pocket. Although these prior attempts to provide a means for carrying a personal knife in a convenient manner have been somewhat successful, problems and difficulties have been encountered when the design of the knife includes other tools or implements that may be used in place of or in connection with the knife blade itself. Furthermore, the ultimate use of the knife is paramount in determining how the knife should be carried. For example, in instances where a knife or other implements are intended to be carrier by underwater divers, such as scuba divers, the knife should be able to be readily attached to or removed from the body of the diver in a convenient manner and when the diver is wearing gloves. Also, it is of great convenience for the diver when he can open the blade with one hand while his other hand is carrying additional equipment such as a speargun, light or probe.

Under such circumstances, it is of a necessity that whatever attachment is used for releasably securing the knife to the clothing or equipment of the diver, such connector, coupling or the like must not interfere with the use of the knife blade when it is in its extended position. A folding blade is of great convenience since it may be stored within the handle of the knife when not in use and can be extended to its operative position when in use. Therefore, the user does not run the risk of being cut or otherwise injured by an open blade either at its point or edge when the knife is being carried.

Therefore, a long standing need has existed to provide a utility knife which may be readily carried by a releasable fastener on the equipment or wearing apparel of the user wherein the attachment means is not obstructive to the use of a folding blade when the blade is in its unfolded and operative position. Also, the utility knife must have provision for a variety of implements or tools that may be used to perform a variety of functions when the knife blade is in its folded position.

SUMMARY OF THE INVENTION

Accordingly, the above problems and difficulties are obviated by the present invention which provides a novel utility knife having an elongated housing for carrying a pivotal blade at one end adjacent to an integral releasable, resilient fastening means suitable for detachable connecting relationship with a belt or belt loop of the user. The blade is characterized as having an enlarged portion with a finger depression such as a hole formed therein readily grasped by the thumb and finger of the user so as to provide for single-handed unfolding of the knife blade. A feature resides in the provision that the fastening means be conformal in shape with the shape of the enlarged portion of the blade so that when the blade is in its extended position, the fastening means forms a useful portion of the handle permitting the user to more readily use the sharpened edge of the blade.

Furthermore, the blade is characterized as having a channel formed along the back of the blade terminating in a cutting edge so that a line cutter results, adding to the usefulness of the knife. The end of the knife housing or body from its end carrying the pivoting blade and fastening means may be provided with an elongated tapered member comprising a pry bar which provides additional utility for the utility knife. A releasable lock mechanism is operably carried on the body for retaining the blade in its open position adjacent to the fastening means.

Therefore, it is among the primary objects of the present invention to provide a novel utility knife which may be readily carried from a loop or belt by means of a snap shackle or fastener which may be readily operated by a gloved hand.

Another object of the present invention is to provide a novel utility knife having a folding blade adapted to be opened by the fingers of one hand and wherein the blade incorporates not only a sharpened edge but a channel cutter as well.

Still another object of the present invention is to provide a novel utility knife having a variety of implements or tools carried on the body which may take the form of a folding cutting edge, a channel cutter, a pry bar or the like.

Yet another object of the present invention is to provide a novel sports knife that may be used in active situations, such as scuba diving, skin diving, sky diving or the like, which incorporates an enlarged latch release opening so that a gloved finger may be used to operate the latch for holding a blade in its open position preparatory for release.

Still a further object of the present invention is to provide a novel utility knife which not only includes a fixed shackle at one end, but permits the shackle to be rotated into the body for storage purposes and which further includes openings into the body for drainage purposes and drying purposes when the utility knife has been subjected to moisture or water environments.

Another object of the present invention is to provide a novel utility knife which may include a snap shackle at one end of its housing or body that may be fixed or movable into the body or housing for storage purposes and which further includes a tool or implement at its opposite end useful in connection with a particular sports activity.

Another object resides in the utility knife's having a line cutter on the back side of an extendable blade and which further includes attachment means for releasably securing the knife to the clothing or equipment of the user and which further includes added implements, tools or the like integrally formed with the housing or body that may be used by the user in addition to the knife blade and line cutter.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
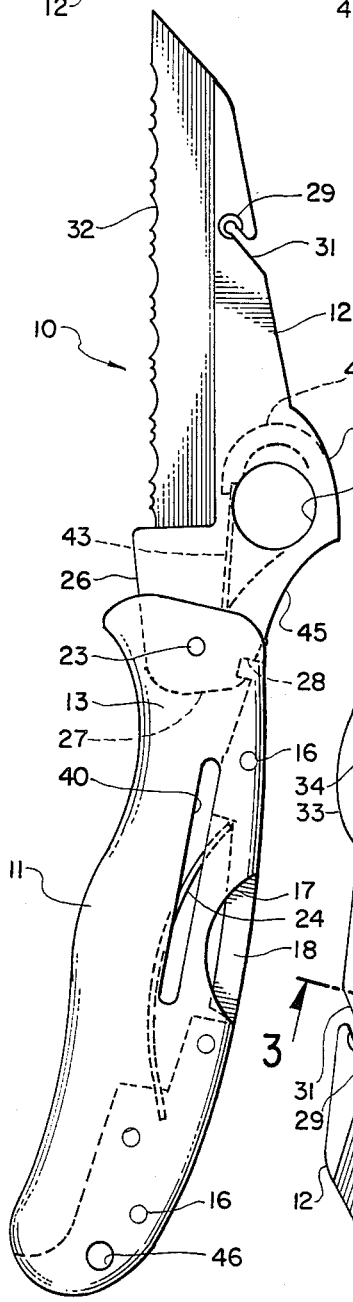
FIG. 1 is a side elevational view of the novel utility knife incorporating the present invention and illustrated with the blade in its open or operative position.
Figure 2:
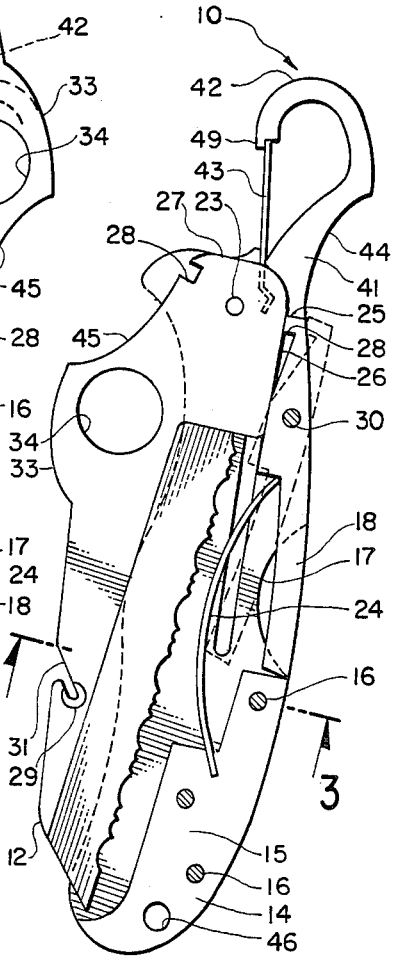
FIG. 2 is a longitudinal cross-sectional view of the utility knife shown in FIG. 1, exposing the snap shackle for carrying or transportation purposes.

Referring to FIGS. 1 and 2, the novel utility knife of the present invention is illustrated in the general direction of arrow 10 which includes a body or housing illustrated in general by numeral 11. The body or housing is intended to be the handle of the knife when a blade 12 has been extended from its closed position as shown in FIG. 2 to its open position as shown in FIG. 1. The blade 12 is confined in a cavity in its closed position between a pair of elongated side portions 13 and 14 which are separated by a spacer 15, which takes the form of projections integrally formed on the side portions 13 and 14 and which will be described later. The side portions 13 and 14 are held together by means of a plurality of rivets, fasteners or the like, such as is illustrated by numeral 16. Also, the side portions 13 and 14 include semicircular cutouts indicated by numeral 17 which are coaxially related with respect to each other so as to expose a portion of a locking or retaining mechanism 18. The mechanism 18 is employed for holding the blade in an open or operative position. It is to be particularly noted that the cutouts 17 are oversized so as to permit entrance of a gloved finger into the cutouts during the release of the mechanism 18 when it is desired to close the knife by pivoting the blade into the storage position shown in FIG. 2.

Referring now in detail to FIG. 2, it can be seen that the blade 12 is pivotally carried with respect to the body 11 by means of a pivot pin 23. A leaf spring 24 is arranged so that one end is attached to the spacer portion of the side portion by an interference fit in a corresponding slot so that the spring cantilevers outwardly into the cavity so that its opposite end bears against the underside of the lock mechanism 18. The leaf spring 24 is substantially arcuate in cross-section so as to provide a normal bias against the underside of the lever for the mechanism 18, urging its opposite end, illustrated by numeral 25, into engagement with a flat surface 26 on the underside of the knife blade 12. In this fashion, the blade is yieldably held in the closed position by the bias of the leaf spring 24. Referring in detail to FIG. 1, when it is desired to actuate the knife blade 12 from its closed position in FIG. 2 to its open position in FIG. 1, the blade is rotated against the bias of spring 24 so that the latch of the mechanism 18 assumes the position in broken lines. Once the blade has been extended to its forward open and operative position, the cam surface, indicated by numeral 27, causes the latch of the lever mechanism 18 to drop into a corresponding notch, indicated by numeral 28. The bias of the spring 24 now urges the lever of the mechanism to rotate about its central pivot 30 so that the latch 25 is retained within the notch 28. With the knife blade 12 in its operative position, it is noted that cutting edge 32 is exposed for use. The cutting edge 32 is elongated and substantially extends across the full length of the blade on the underside or edge thereof while its topside or edge is provided with a slotted or grooved line cutter, indicated by numeral 31. The bottom of the groove or notch 31 is sharpened, as indicated by numeral 29, in order to provide a cutting edge for severing a line, cord or the like.

Also, it is noted that the top edge marginal region of the blade includes an enlarged portion 33 which is provided with a depression or opening 34. The enlarged portion 33 in the depression or opening 34 is useful to the user in opening the blade from its closed position, using the fingers of one hand. Preferably, the thumb of one hand engages with the depression or opening 34 while the back of the knife adjacent to the separator or spacer 15 fits against the palm of the hand. By forcibly urging the thumb outwardly, the blade 12 will follow the movement and open past the spring bias of spring 24. Once the resistance of the spring has been overcome, the blade 12 may readily be carried to its full operative position until stopped by insertion of the latch 25 into the notch 28.

FIGS. 1 and 2 further show that the housing or body 11 is provided with elongated slots for opening, as indicated by numeral 40, with respect to side piece 13. The oversized semicircular openings 17, as well as the lateral slots or openings 40, serve as drainage means when the utility knife is subjected to moist or wet environmental conditions. Also, the openings serve as vents for drying the interior of the housing in order to eliminate or substantially reduce oxidation, rust or collection of moisture.

A major feature of the present invention resides in the provision of a snap shackle, indicated by numeral 41, which is integrally carried on one end of the body by being formed with section 14 of the body. The snap shackle outwardly projects in a cantilevered manner from the end of the body pivotally carrying the blade 12. The shackle includes a loop portion 42 which forms a hook and in combination with a resilient member 43, such as a spring, closes the opening to form the shackle. The end of spring 43 bears against a flanged shoulder 49 carried on the end of the hook of the shackle whereby the interior of the shackle is closed. In this manner, the shackle is used to hook onto the belt of the user, a belt loop or any other suitable eyelet or provision on the user's clothing or equipment. A special feature resides in the formation of the shackle with a sloping or slightly curved backside 44, which is conformal in shape to the backside 45 of the knife blade 12. Thus, when the knife is in the operative position, as shown in FIG. 1, the contour of the blade at 45 in adjacent to and conformal with the sloping or curved backside 44 of the shackle 41. This permits the user's thumb to be pressed against the backside of the blade for additional support when pressure is placed onto the blade. Also, the user's hand may readily be gripped further forward than is possible on conventional knives with the user's hand bearing against the combined and cooperating back surfaces 44 and 45. Thus, the snap shackle 41 is not obstructing the use of the cutting edge of the blade or in the use of the line cutter 31. The single hand opening depression 34 is substantially coaxially disposed with respect to the opening of the shackle 41, as illustrated in FIG. 1.

If desired, a lanyard or other attachment means may be provided in combination with an opening or hole 46. Other support, holding, or attachment means can be used for supporting the knife from the equipment or person of the user besides the snap shackle when the opening and lanyard 46 are employed.

Figure 4:
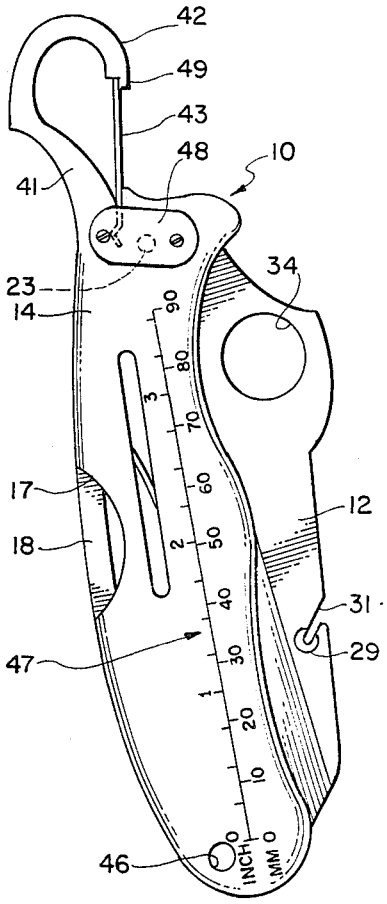
FIG. 4 is a side elevational view of the utility knife taken on the opposite side from the view shown in FIG. 2, illustrating a display area for carrying indicia.

Referring now in detail to FIG. 4, it can be seen that a substantial surface on the body piece, such as side piece 14, can be used for display purposes. In the present illustration, a scale shown in the direction of arrow 47 may be carried and is useful to the user for the taking of measurement purposes. In other applications, other indicia, alpha-numeric characters or the like can be carried on the display area which would be suitable for the active sport engaged by the user.

Figure 5:
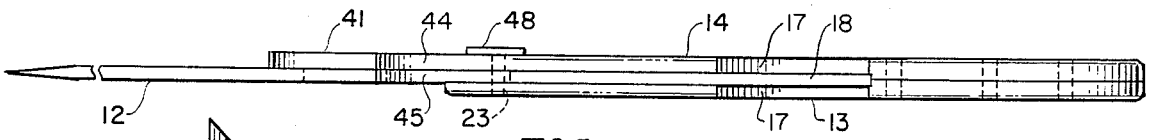
FIG. 5 is a top plan view of the knife shown in FIGS. 1–4 inclusive.
Figure 3:
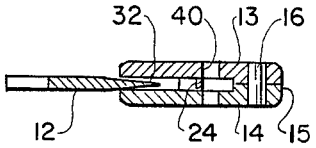
FIG. 3 is a transverse cross-sectional view of the utility knife as taken in the direction of arrows 3—3 of FIG. 2.

Referring now in detail to FIG. 5, it can be seen that the snap shackle 41 resides adjacent to the blade 12 when the blade is in its operative position. No interference is provided and the leaf spring 43 is held in position by means of a riveted or screwed plate 48. The plate 48 may also be used for holding the pivot pin in position. Removal of plate 48 permits service and maintenance as well as repair for the leaf spring 43 and the pivot pin.

Figure 6:
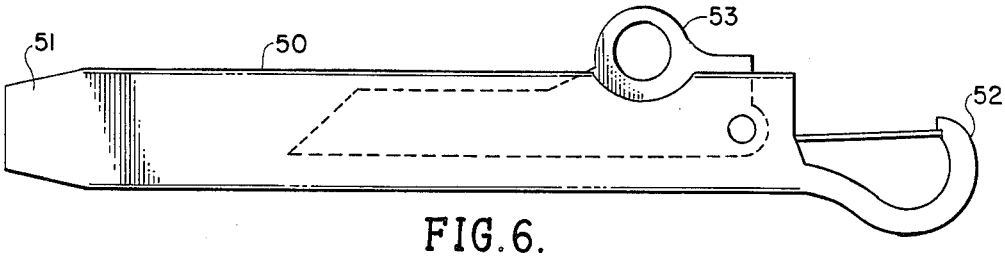
FIG. 6 is a side elevational view of another version of utility knife incorporating a tool or implement integrally formed on the housing or body.

Referring now in detail to FIG. 6, another embodiment of the invention is shown wherein the body or housing of the utility knife is indicated by numeral 50 and a pry bar 51 is included on the end of the body opposite to its end carrying a snap shackle 52. The knife includes a blade similar to the one illustrated in the earlier version and is indicated by numeral 53. Therefore, it can be seen that the body or housing can include tools or implements which are integrally formed with the body and are operative from the end of the body or housing opposite to its end carrying the snap shackle and the pivot connection for the blade.

Therefore, it can be seen that the knife construction of the present invention provides not only a knife blade but a line cutter and other implements of utility. The snap shackle arrangement permits the knife to be carried outside of the pocket of the user in a ready position, either on the apparel of the user or his equipment. Not only may the snap shackle be operated by the fingers of one hand of the user, but the blade may also be extended from its storage position to its operative position by the single-handed use of the user. The enlarged openings for operating the release mechanism 18 are of great advantage to persons having gloved fingers and the enlarged openings, as well as the drying slots 40, are useful in drainage and drying purposes.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A pocket utility knife comprising the combination of:

an elongated body having opposite side portions separated by a spacer defining a cavity opening from one side of said body;

a blade pivotally carried on said body operable between alternate positions of being stored in said cavity or being open in an operative position as an extension of said body;

said blade having a predetermined shape including an enlarged portion projecting from its upper top edge and outwardly projecting through said handle cavity opening beyond said handle on one side so as to provide an exposed lobe;

a selected one of said body side portions having a shaped extension integrally carried on one end adjacent to said pivot connection of said blade with said body projecting outwardly beyond the terminating end of said other side portion;

said shaped extension having a peripheral edge configuration conformal with said blade enlarged portion so as to be matable in parallel side-by-side relationship when said blade is in its operable position.

2. The invention as defined in claim 1 wherein:

said shaped extension consitutes an attachment means for releasably supporting and retaining said knife from garments of the user.

3. The invention as defined in claim 2 wherein:

said attachment means is a snap shackle having a hook defining an eyelet in cooperation with a leaf spring.

4. The invention as defined in claim 3 wherein:

said snap shackle includes a semicircular external surface matable in parallel side-by-side relationship with a semicircular external surface carried on said blade enlarged portion;

said semicircular external surfaces combining to constitute thumb pressure surfaces against which the user's thumb bears.

5. The invention as defined in claim 4 wherein:

said selected one body is side portion includes a tool or implement integrally carried on its end opposite to its end carrying said shaped extension.

6. The invention as defined in claim 5 wherein:

said enlarged portion of said blade is provided with a laterally facing depression adapted to be physically engaged by the flesh of the user's thumb to effect single-handed pivoting of said blade into its operative position.

7. The invention as defined in claim 6 wherein:

said blade top side includes a cutter hook provided in its peripheral edge;

said cutter hook being exposed from said body in either blade storage or operative positions.

8. The invention as defined in claim 4 wherein:

said side portions of said body are provided with vent openings for conducting drain water therethrough.

9. The invention as defined in claim 8 wherein:

said selected body side portion includes a measurement scale carried on the external surface extending substantially across the length of said body selected side portion.

10. The invention as defined in claim 9 including:

latch means resiliently biasing said blade in either of its storage or operative positions.

* * * * *